US006070387A

United States Patent [19]

Salicini

[11] Patent Number: 6,070,387

[45] Date of Patent: Jun. 6, 2000

[54] FEEDER FOR MACHINES FOR WRAPPING SMALL- AND MEDIUM-SIZE PRODUCTS, PARTICULARLY CONFECTIONERY PRODUCTS

[75] Inventor: Sandro Salicini, Monterenzio, Italy

[73] Assignee: A.M.S. S.r.l., Milan, Italy

[21] Appl. No.: 08/891,070

[22] Filed: Jul. 10, 1997

[30] Foreign Application Priority Data

Jul. 15, 1996 [IT] Italy ..... B096A0388

[51] Int. Cl.[7] ..... B65B 11/36; B65B 35/26

[52] U.S. Cl. ..... 53/234; 53/227; 53/252

[58] Field of Search ..... 53/234, 228, 227, 53/252, 251

[56] References Cited

U.S. PATENT DOCUMENTS

| | | | |
|---|---|---|---|
| 2,276,584 | 3/1942 | Malhiot . | |
| 2,351,838 | 6/1944 | Saladin | 198/24 |
| 2,744,370 | 5/1956 | Seragnoli | 53/227 X |
| 3,890,766 | 6/1975 | Hatta | 53/234 |
| 4,768,639 | 9/1988 | Gamberini et al. | 53/234 X |
| 5,519,981 | 5/1996 | Fukusaki | 53/234 X |

FOREIGN PATENT DOCUMENTS

| | | |
|---|---|---|
| 2 439 132 | 5/1980 | France . |
| 227 764 | 1/1925 | United Kingdom . |
| 252 179 | 9/1926 | United Kingdom . |
| 326 831 | 3/1930 | United Kingdom . |
| 2 164 913 | 4/1986 | United Kingdom . |

*Primary Examiner*—James F. Coan
*Attorney, Agent, or Firm*—Guido Modiano; Albert Josif; Daniel O'Byrne

[57] ABSTRACT

A feeder for the gripper head of wrapping machines for small- and medium-size products, comprising: a disk, which substantially lies horizontally and rotates about a vertical axis; recesses for receiving a respective product, which are distributed all around the disk, are spoon-shaped and have a slot which is open towards the outside of the disk and can be crossed substantially along a plane that passes through the vertical axis; an extractor which cooperates, in a transfer station which corresponds to one of said recesses and to a gripper, with a corresponding complementary element and with a device for dispensing a piece of material in sheet form and is suitable to intersect and pass beyond the recess with an active stroke in the vertical plane, passing through the slot in an upward and outward direction so that the product and the material in sheet form are secured against the complementary element and so that by means of the complementary element the product and the material are inserted in the gripper, whilst the extractor performs its return stroke below the disk.

10 Claims, 3 Drawing Sheets

FIG.2
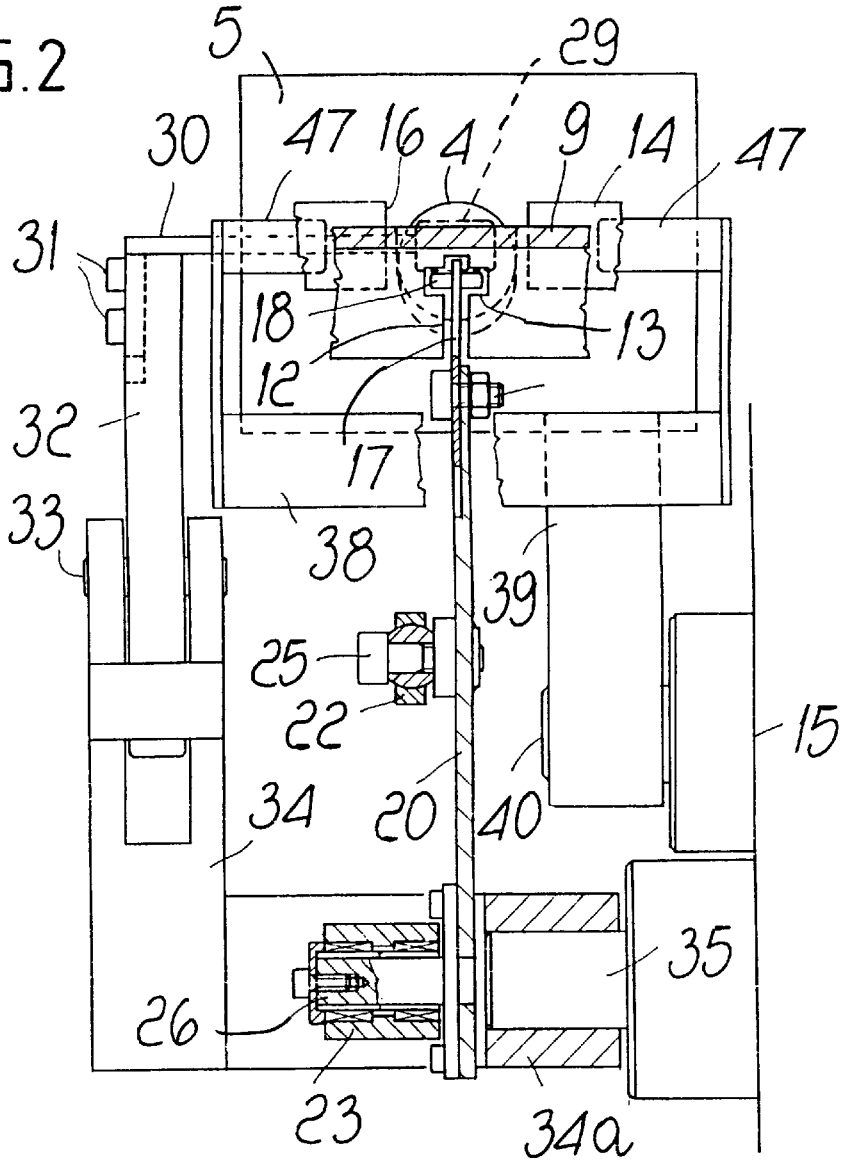
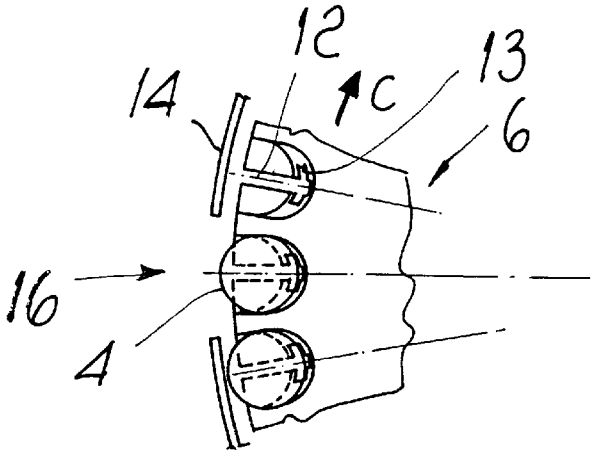
FIG.3

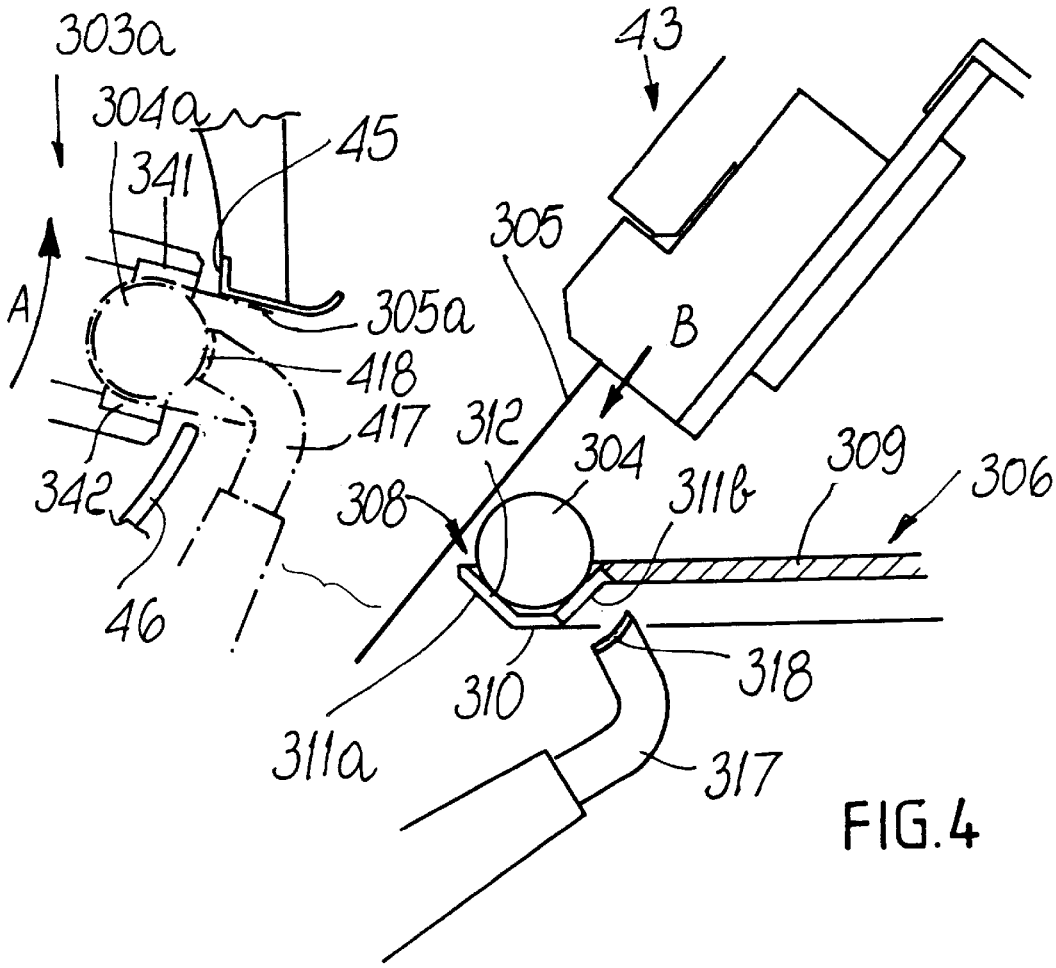
FIG.4
FIG. 5
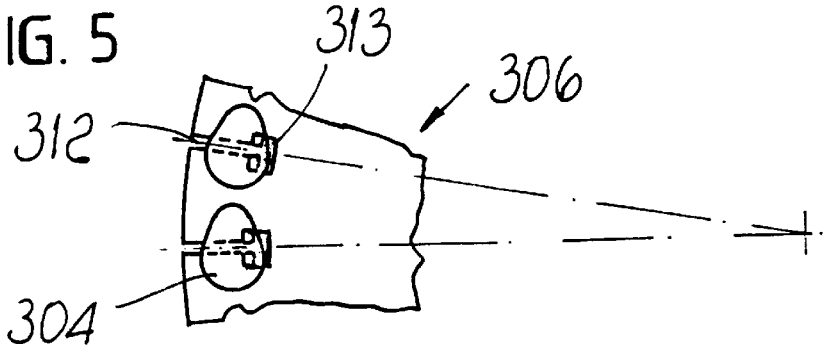

FEEDER FOR MACHINES FOR WRAPPING SMALL- AND MEDIUM-SIZE PRODUCTS, PARTICULARLY CONFECTIONERY PRODUCTS

BACKGROUND OF THE INVENTION

The present invention relates to a feeder for machines for wrapping small- and medium-size products, particularly confectionery products.

Conventional machines for wrapping products of the above-mentioned kind have a disk-like feeder and a wrapping head which rotate respectively about a vertical axis and a horizontal axis.

The individual products are received by respective recesses which are open upward and distributed along the peripheral region of the horizontal disk. In each instance, the product of a recess is transferred into one of the grippers of the head together with the piece of material in sheet form which is handled in the head and is meant to wrap and enclose the product.

The product is transferred in a corresponding station by an extractor which, with a rising stroke, passes through a hole of the bottom of the recess, crosses the horizontal disk from below, and lifts the product off it up to the corresponding gripper of the wrapping head.

With a descending stroke, the extractor then ceases to intersect the horizontal disk, leaving it free to rotate so that a new recess with the product moves into the transfer station.

In some conventional wrapping machines, slowness in operation caused by the alternating vertical strokes of the extractor is handled by making the extractor also perform simultaneous horizontal alternating strokes which follow the path of the recesses, respectively advancing with them and then retracting with respect to them.

Also due to such feeders, it has been necessary to provide wrapping machines with kinematic chains having variously orientated shafts, which have made such machines bulky and complicated and hinder access to the various actuation elements.

Moreover, the operating times of a feeder with disk and vertical extractor do not fit in well with those of the device that delivers the piece of material in sheet form to it, thus negatively affecting the productivity of the wrapping machine.

SUMMARY OF THE INVENTION

The aim of the present invention is to provide a feeder for wrapping machines, particularly for generally spherical products, including medium-size ones, which is devised with special care in order to give the various elements the time required to appropriately perform their tasks without negatively affecting the productivity of the wrapping machine.

Within the scope of this aim, an object of the present invention is to provide a feeder which is very simple and economical to manufacture, provides wide access to the various actuation elements, decisively contributes to the compact size of the wrapping machine and offers great reliability and safety in operation.

This aim, this object and others which will become apparent hereinafter are achieved by a feeder according to the invention for the gripper head of wrapping machines for small- and medium-size products, which is characterized in that it comprises: a disk, which substantially lies horizontally and rotates about a vertical axis; recesses for receiving a respective product, which are distributed all around said disk, are spoon-shaped and have a slot which is open towards the outside of said disk and can be crossed substantially along a plane that passes through said vertical axis; an extractor which cooperates, in a transfer station which corresponds to one of said recesses and to a gripper, with a corresponding complementary element and with a device for dispensing a piece of material in sheet form and is suitable to intersect and pass beyond said one of said recesses with an active stroke in said vertical plane, passing through its said slot in an upward and outward direction so that the product and the material in sheet form are secured against said complementary element and so that by means of said complementary element the product and the material are inserted in said gripper, whilst said extractor performs its return stroke below said disk.

BRIEF DESCRIPTION OF THE DRAWINGS

Further characteristics and advantages of the invention will become apparent from the following detailed description of preferred embodiments of the feeder according to the invention, illustrated only by way of non-limitative example in the accompanying drawings, wherein:

FIG. 2 is a sectional view thereof, taken along the plane II—II of FIG. 1;

FIG. 3 is a partial plan view thereof;

FIG. 4 is a schematic partial view, similar to FIG. 1, of a second embodiment of the feeder;

FIG. 5 is a partial plan view of the second embodiment of the invention shown in FIG. 4.

DESCRIPTION OF THE PREFERRED EMBODIMENTS

Figure 1:
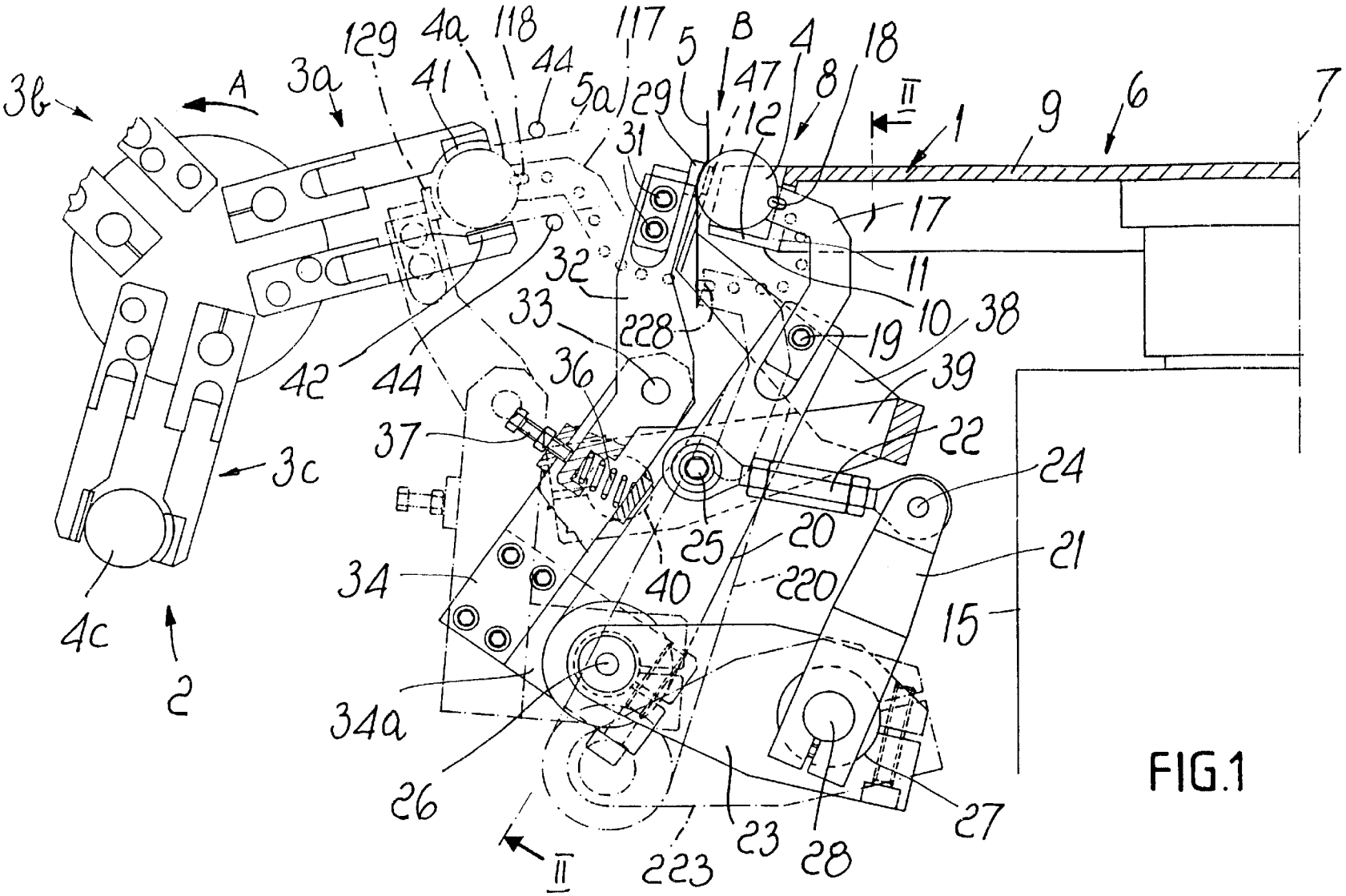
FIG. 1 is a substantially longitudinal elevation view of the feeder according to the present invention.

With particular reference initially to FIGS. 1, 2 and 3, the feeder 1 according to the invention is meant to feed the gripper head 2 of wrapping machines for small-size products (particularly confectionery products such as chocolates, for example). In particular, the feeder 1 and the head 2 are suitable to handle generally spherical products. Preferably, the head 2, which rotates intermittently in the direction A about a horizontal axis, is of the three-station type disclosed in Italian patent application no. BO96A000169 in the name of the same Applicant and by the same inventor.

The feeder 1 causes the insertion of a product and of a corresponding piece of material in sheet form, designated by the reference numerals 4*a* and 5*a* respectively in said station, into a gripper 3*a* which arrives in the open condition at a first one of the stations.

The product 4*c* of the gripper 3*c*, which is in the third station, is already wrapped in the wrapping formed with the piece of material in sheet form and is ready to be expelled from the gripper by means of an actuator, not shown. The wrapping is formed between the first station and the third station and particularly in the second station (the gripper located at the second station is designated by the reference numeral 3*b*).

The feeder comprises a circular disk 6 which is arranged horizontally and rotates about a vertical axis 7.

Disk 6 is provided with recesses 8, distributed all around it, for receiving respective products 4.

The recesses are spoon-shaped and are open upward and outward; in practice, they are located below the plate 9 that constitutes the main part of the disk 6. Substantially, they are tangent to the product 4 not only laterally but also to the rear and below, respectively by virtue of their base 10, which descends towards the inside of the disk 6, and with their back wall 11.

A slot 12 lies in a median arrangement along a vertical plane that passes through the axis 7 in the entire base 10 and in the back wall 11 of each recess; in its upper part, the slot is preferably provided with a transverse portion 13 so as to assume as a whole a cross-like shape.

The disk 6 is surrounded by a rim 14 which is supported by the frame of the wrapping machine; the frame is generally designated by the reference numeral 15. The purpose of the rim is to contain the products 4 which, in a conventional manner, are placed onto the plate 9 in order to reach the recesses 4; the upper surface of the plate slopes slightly towards the recesses 4 for this purpose. In any case, the rim 14 leaves a gap 16 open at a transfer station which faces the gripper 3*a*.

An extractor operates at said transfer station and includes a region 17 which is flattened in a vertical plane that passes through the axis 7 and preferably includes a cross-member 18 which is arranged in front of the upper part of the region 17 and is shaped so as to follow the curvature of the product 4. As described hereafter, the extractor 17–18 is meant to pass with clearance through the slot 12–13. The extractor is fixed, by means of a screw element 19, to the top of a first rocker 20 of which it constitutes a sort of upward extension.

The rocker 20 is part of an articulated quadrilateral which substantially lies on the vertical plane of the transfer station, i.e., in the plane which is common to the axis 7 and to the grippers 3, and furthermore comprises a second rocker 21, a traction element 22, and a member 23. The traction element 22 is articulated at 24 and 25 to the respective rockers 21 and 20 and the lower end of the rocker 20 is articulated at 26 to an end of the member 23.

The other end of the member 23 is fixed to a tubular element 27 which is oscillatably mounted on a pivot 28 which is in turn oscillatably mounted on the frame 15 and supports the lower end of the rocker 21, which is fixed thereto.

As better explained hereinafter, the tubular element 17 and the pivot 28 are actuated by cam devices which are not shown. Through the actuation imparted to the tubular element 27, the member 23, during part of a transfer cycle, remains in the raised position, shown in solid lines in FIG. 1, and descends, during the remaining part, to the lowered position 223 and rises back from there to the raised position.

A complementary end element 29 cooperates with the extractor 17–18 and is fixed to a bracket 30 which is fixed at 31 on top of a secondary arm 32; the secondary arm is pivoted at 33 to the upper part of a primary arm 34 whose lower part 34*a* is fixed to a pivot 35 which is again actuated by a cam device. When the member 23 is in the raised position, the axis of the pivot 26 is coaxial to the axis of the pivot 35.

A spring 36 tends to keep the lower end of the secondary arm 32 in abutment against the adjustment screw 37.

A sort of fork 38 can cooperate with the extractor 17–18 and with the complementary element 29, a lower tab 39 of the fork being fixed to the pivot 40 which is again actuated by a cam device.

It is noted that to the benefit of the architecture of the wrapping machine all the pivots and articulations described above are parallel to the rotation axis of the head 2 and that the orientation can be common to the shafts of the cam devices; furthermore, the feeder, which is mostly arranged outside the frame of the machine, is advantageous from the point of view of accessibility.

With reference now to FIGS. 4 and 5, the feeder shown schematically therein is meant to feed medium-size products 304 (the numbers used now are increased by three hundred with respect to those used in FIGS. 1, 2 and 3 for similar elements), for example eggs with a size of approximately four to six centimeters.

In this case, the products 304 reach the respective recesses 308 of the disk 306 by preferably being placed manually therein by an assigned operator; the operator loads the products into the recesses when the recesses are at a certain distance from the transfer station.

Substantially, each recess 308 is open upward and is tangent to the product 304 located therein not only laterally but also to the front and to the rear with its respective walls 311*a* and 331*b*, which converge towards the base 310 of the recess and are arranged below the plate 309 of the disk 306 together with the base. The portion 313, which lies transversely to the slot 312 arranged in a median position with respect to the recess, substantially affects the rear wall 311*b* along its entire vertical extension and corresponds to the cross-member 318, which is arranged in front of the flat region 317 of the extractor (the complementary element that cooperates with the extractor 317–318 is not shown in FIG. 4).

In the embodiment of FIGS. 4 and 5 there is no rim 14 owing to the configuration of the recesses 308 and because the products are loaded manually into the recesses.

The operation of the feeder is as follows. A product 4*a* (304*a*) and a sheet 5*a* (305*a*) are inserted between the jaws 41 (341) and 42 (342) of the gripper 3*a* (303*a*) by means of the combined action of the extractor and of the complementary element, which in the corresponding positions, in front and behind the jaws, are designated by the reference numerals 117–118 (417–418) and 129, respectively, and are shown in dot-and-dash lines.

After the jaws 41 (341) and 42 (342) have gripped the product, the extractor starts to perform its return stroke towards the disk 6 (306), whilst by turning the head 2 in the direction A the gripper 3*a* (303*a*) reaches the subsequent second station.

During the return stroke, the extractor passes below the disk 6 (306), then rises and is arranged behind the new recess 8 (308) to be crossed, which the disk is bringing into the transfer station. In FIG. 1, the plurality of circles traces the path followed by the cross-member 18 of the extractor during the return stroke; by means of the angular stroke for spacing from the gripper 3*a*, the path is determined by the equally orientated stroke imparted to the rocker 21, whilst as regards the descent and ascent of the extractor it is determined respectively by the lowering and lifting imparted to the member 23: the position 220 of the rocker 20 and the position 228 of the cross-member 18 correspond to the position 223 of said member 23.

While the extractor performs one of its cycles, which includes an active stroke and a return stroke, the disk 6 (306) rotates, for example in the direction C (FIG. 3), by the extent of the spacing between one recess and the next; the disk can rotate intermittently, so that a recess stops each time in the transfer station, or can rotate continuously but not uniformly, slowing down whenever a recess passes through the transfer station.

Once the gripper with the product 4*a* (304*a*) has moved away from 3*a* (303*a*), the complementary element 29 also performs its return stroke until it is proximate to the peripheral region of the disk 6 (306). Meanwhile, a conventional device 43 (FIG. 3) has dispensed material in sheet form in the direction B and outside the peripheral region of the disk 6 (306); the material is cut so as to form the piece 5 (305) as soon as the extractor starts to pass through the slot 12 (312) of the recess, which is in the transfer station, and to secure the product 4 (304) and the piece 5 (305) against the complementary element 29. The securing of the product corresponds to the loading of the spring 36.

Attention is brought to the length of the time available to the dispenser 43 to feed the piece of material in sheet form without this interfering with the extractor and with the cooperating complementary element; this improves the quality of the work of the dispenser and allows to easily feed long pieces of material in sheet form, suitable to wrap medium-size products.

Once the securing has occurred, the extractor and the complementary element perform together the active stroke towards the new gripper 3*a* (303*a*); the extractor ceases to intersect the recess and passes beyond it and the member 23 is in the raised position.

During their active stroke, the extractor, the complementary element and the product pass through a forced passage constituted by two elements 44 which are rigidly coupled to the frame 15 (FIG. 1) and causes the piece of material in sheet form to fold above and below the product. Once the product has been secured by the jaws 341–342, the combined action of conventional folding elements 45 and 46 (FIG. 3) provides for additional steps for folding the material in sheet form to prepare for the provision of the wrapping around the product; the folding element 45 is fixed to the frame of the wrapping machine and lies around the gripper head, around which the laminar folding element 46 lies and oscillates.

If the material in sheet form is rather light, as in the case of particular configurations of the products, during the active stroke it can be useful to use a conveyance guide for the material in sheet form, constituted by the ends 47 of the fork 38 (FIGS. 1 and 2). The mutually facing ends are almost tangent to the peripheral region of the disk 6 (306) and to the respective sides of the product at the beginning of the active stroke; they follow the extractor and the complementary element up to the vicinity of the gripper 3*a* (303*a*).

The feeder thus conceived therefore achieves the intended aim and object.

In the practical embodiment of the invention, the materials employed, as well as the shape and the dimensions, may be any according to requirements.

What is claimed is:

1. A feeder for the gripper head of wrapping machines for small- and medium-size products, comprising: a disk, which substantially lies horizontally and rotates about a vertical axis; recesses for receiving a respective product, which are distributed all around said disk, are spoon-shaped and have a slot which is open towards the outside of said disk and can be crossed substantially along a plane that passes through said vertical axis; an extractor which cooperates, in a transfer station which corresponds to one of said recesses and to a gripper, with a corresponding complementary element and with a device for dispensing a piece of material in sheet form and is suitable to intersect and pass beyond said one of said recesses with an active stroke in said vertical plane, passing through its said slot in an upward and outward direction with respect to said disk so that the product and the material in sheet form are secured against said complementary element and so that by means of said complementary element the product and the material are inserted in said gripper, whilst said extractor performs its return stroke below said disk, the feeder further comprising an articulated quadrilateral having four members which are mutually articulated at four articulations so as to form said articulated quadrilateral, said extractor being connected to one of said four members of said articulated quadrilateral such that said extractor moves in said upward and outward direction during said active stroke when said articulated quadrilateral is activated into motion.

2. A feeder according to claim 1, wherein an upward extension of a first rocker of said articulated quadrilateral ends with said extractor, said quadrilateral being arranged along said vertical plane and having a second rocker in which a pivot of a lower end of said second rocker is actuated so as to make said extractor perform the angular strokes between said recess and said gripper, the articulated quadrilateral having member that lies between the lower ends of the two rockers being actuated, coaxially to said pivot, so that it remains in a raised position during said active stroke of said extractor and so as to make said extractor perform said return stroke below said disk.

3. A feeder according to claim 2, wherein an arm mounted on a pivot in a downward region has an upward end portion connected with said complementary element, said pivot of said arm being actuated so as to make said complementary element perform the angular strokes between said recess and said gripper, said first rocker having a lower end pivot which is coaxial to said pivot of said arm connected with said complementary element when said member remains in said raised position.

4. A feeder according to claim 3, wherein the upward end portion of said arm is spring-loaded for a securing action of said complementary element and wherein the load of the corresponding spring is adjustable.

5. A feeder according to claim 1, wherein said extractor and said slot are cross-shaped, and wherein there is mutual clearance between said extractor and said slot, a flattened region along said vertical plane and a cross-member which lies frontally thereto forming the cross-shape of said extractor, said slot being median with respect to said respective recess and being provided, in an upper part, with a transverse portion that corresponds to said cross-member.

6. A feeder according to claim 1, wherein a rim is arranged so as to surround said disk in a manner which is suitable to contain the products located on said disk, said rim having a gap open at said transfer station.

7. A feeder according to claim 1, wherein a forced passage is located in said transfer station between said recess and said gripper and is suitable to make said piece of material in sheet form fold above and below the product transferred by said extractor and said complementary element.

8. A feeder according to claim 7, further comprising a fork which follows said angular strokes of said extractor and said complementary element such as to remain to the respective sides of the product transferred by said extractor and said complementary element so as to follow a respective said piece of material in sheet form.

9. A feeder according to claim 1, wherein said disk is continuously but not uniformly rotatable so as to slow whenever one of said recesses passes at said transfer station.

10. A feeder according to claim 1, wherein said disk is intermittently rotatably such that one of said recesses stops in each instance in said transfer station.

* * * * *